US005754005A

United States Patent [19]

Sakoske et al.

[11] Patent Number: 5,754,005

[45] Date of Patent: May 19, 1998

[54] ELECTRIC LAMPS CONTAINING ELECTRICAL LEADS OF A MOLYBDENUM AND TUNGSTEN ALLOY

[75] Inventors: George E. Sakoske, Chagrin Falls; Wayne A. Lasch, Shaker Heights; Joseph M. Ranish, Cleveland Heights; Milan R. Vukcevich, University Heights; Thomas H. Yu, Richmond Heights; Bernard W. Rachel, Highland Heights; Richard G. Lynce, Chesterland, all of Ohio; István Mészáros, Budapest, Hungary; György Nagy, Budapest, Hungary; Tamás Gál, Hajduboöszörmény, Hungary

[73] Assignee: General Electric Company, Schenectady, N.Y.

[21] Appl. No.: 145,269

[22] Filed: Oct. 29, 1993

[51] Int. Cl.[6] ..... H01J 17/18

[52] U.S. Cl. ..... 313/623; 313/626

[58] Field of Search ..... 313/623–626, 313/633, 352, 311; 140/71.6

[56] References Cited

U.S. PATENT DOCUMENTS

| | | | |
|---|---|---|---|
| 4,160,930 | 7/1979 | Driessen et al. | 313/623 |
| 4,376,906 | 3/1983 | Szilagyi et al. | 313/623 |
| 5,057,742 | 10/1991 | Kawai et al. | 313/623 |
| 5,200,669 | 4/1993 | Dixon et al. | 313/623 |

*Primary Examiner*—David K. Moore
*Assistant Examiner*—Stephen Brinich
*Attorney, Agent, or Firm*—Stanley C. Corwin

[57] ABSTRACT

An inlead for an electric lamp formed of an alloy of tungsten and molybdenum. The inlead has a rate of thermal expansion or contraction approximating that of the glass forming the bulb. This minimizes the expansion/contraction mis-match stress between the two materials. In addition, the alloy composition functions to reduce oxidation and degradation of the lead.

13 Claims, 3 Drawing Sheets

ELECTRIC LAMPS CONTAINING ELECTRICAL LEADS OF A MOLYBDENUM AND TUNGSTEN ALLOY

BACKGROUND OF THE INVENTION

1. Field of the Invention

This invention relates to electrical leads for lamps. Particularly, this invention relates to electrical leads for lamps comprised of an alloy of molybdenum and tungsten.

An electrical lead comprised of an alloy of molybdenum and tungsten is well-suited for use in lamps having relatively high operating temperatures. Accordingly, the leads of the current invention are well suited to lamps comprised of high melting point glass or quartz and are particularly suited to halogen lamps. Throughout the specification, numerous references will be made to the use of leads comprised of an alloy of molybdenum and tungsten in high temperature lamps having quartz, aluminosilicate glass or borosilicate glass bulbs. However, it should be realized that the invention can be used in other lamps and with other types of glass or quartz envelopes.

2. Description of the Art

The industry of electric devices, such as electric lamps, has long been aware of the difficultly in obtaining strong and durable hermetic seals between a lamp envelope or bulb and the lead to the electrodes or filaments therein. Leads are typically comprised of a refractory metal such as tungsten or molybdenum which can withstand the high temperatures necessary for sealing quartz and high temperature glass bulbs. The leads must also withstand the high operation temperatures of the more recently developed lamps, for example halogen lamps (500° C.) and high pressure discharge lamps (700° C.).

During melt-sealing of the quartz or glass envelope to form the bulb, an electrical lead is typically extended from the exterior of the bulb to the interior through a neck portion. However, problems arise because the leads often have a thermal coefficient of expansion/contraction which differs substantially from that of the quartz or the high temperature glass. Upon cooling of the neck portion, immediately after sealing, substantial thermal expansion/contraction mismatch stresses may occur between the lead and the quartz or glass. High stress leads to fissures and cracks in the quartz or glass and either a reject of the lamp or premature failure of the lamp. Thermal expansion/contraction mis-match between the glass or quartz and metal, the thermorheological properties of the glass or quartz, the thermal history of the materials, the elastic properties of the glass or quartz and metal, and the geometry of the seal each impact the quality of the hermetic seal. Nonetheless, the mis-match between thermal expansion/contraction of the metal and the quartz or glass is a primary contributor to high stresses.

To form the bulb, the glass or quartz is frequently sealed by shrink sealing. In shrink sealing, a glass or quartz tube is placed around the lead assembly and is heated. The burner pressure and surface tension shrink the glass or quartz to the lead. Another common method of sealing the lead assembly is to place one end of a quartz or glass tube around the assembly, heat the quartz or glass to its softening temperature, and pinch or press the end of the tube shut between a pair of opposed fast acting jaws.

To reduce the effect of the expansion/contraction mismatch, the electrical lead assembly in high pressure discharge lamps and halogen lamps is often comprised of a foil or ribbon of molybdenum. The foil geometry is thin enough to reduce thermal induced mis-match stress between the metal and bulb. U.S. Pat. Nos. 4,254,356 and 5,158,709 teach foil type inleads and are hereby incorporated by reference.

Alternatively, lamps such as a high pressure sodium discharge lamp may employ a seal button having melting temperatures in excess of 600 degrees centigrade. To compensate for thermal expansion mis-matches, the inleads are passed through a seal button which has a thermal expansion complimentary to that of the arc tube. U.S. Pat. No. 5,001,396 is an example of this type of lamp and is hereby incorporated by reference.

Another method to reduce stress between the inleads and lamp envelope is discussed in U.S. Pat. No. 5,200,669, wherein the electrical elements of the electrode system are wrapped with a metal foil before being melt-sealed into the neck portion of the lamp. The foil has been found to reduce the mis-match stress between the lead and the glass or quartz.

It has been found by those of ordinary skill in the art that these methods of reducing stress between the electrical leads and vitreous envelopes are complicated, expensive and a weak link in the lamp manufacture process.

SUMMARY OF THE INVENTION

Accordingly, it is an object of this invention to provide an electric lamp having a new and improved lead which reduces the thermal expansion/contraction induced mismatch stress encountered at the interface of the lamp envelope and electrical leads.

Another object of the invention is to provide a simple and inexpensive electric discharge lamp lead that can be hermetically sealed to a high temperature glass or quartz lamp envelope to increase the durability of the lamp.

An additional object of the current invention is to reduce the rate of degradation of the lead within the lamp envelope as a result of molybdenum "cold leg corrosion" and to provide an oxidation resistant inlead.

To achieve the foregoing objects in accordance with the purpose of the invention, as embodied and broadly described herein, the electric lamp lead of the current invention comprises an alloy of about 10 to 90 percent by weight tungsten and about 10 to 90 percent by weight molybdenum.

It has been found that the leads of the current invention are especially suited for use in halogen lamps having an aluminosilicate bulb. Preferably, the lead for aluminosilicate bulbs comprises about 20 to 40 percent by weight tungsten and about 60 to 80 percent molybdenum. More preferably, the lead used in a halogen lamp having an aluminosilicate bulb envelope comprises about 30 percent tungsten and about 70 percent molybdenum.

BRIEF DESCRIPTION OF THE DRAWINGS

In the following detailed description, reference will be made to the attached drawings in which.

DETAILED DESCRIPTION OF THE INVENTION

Figure 1:
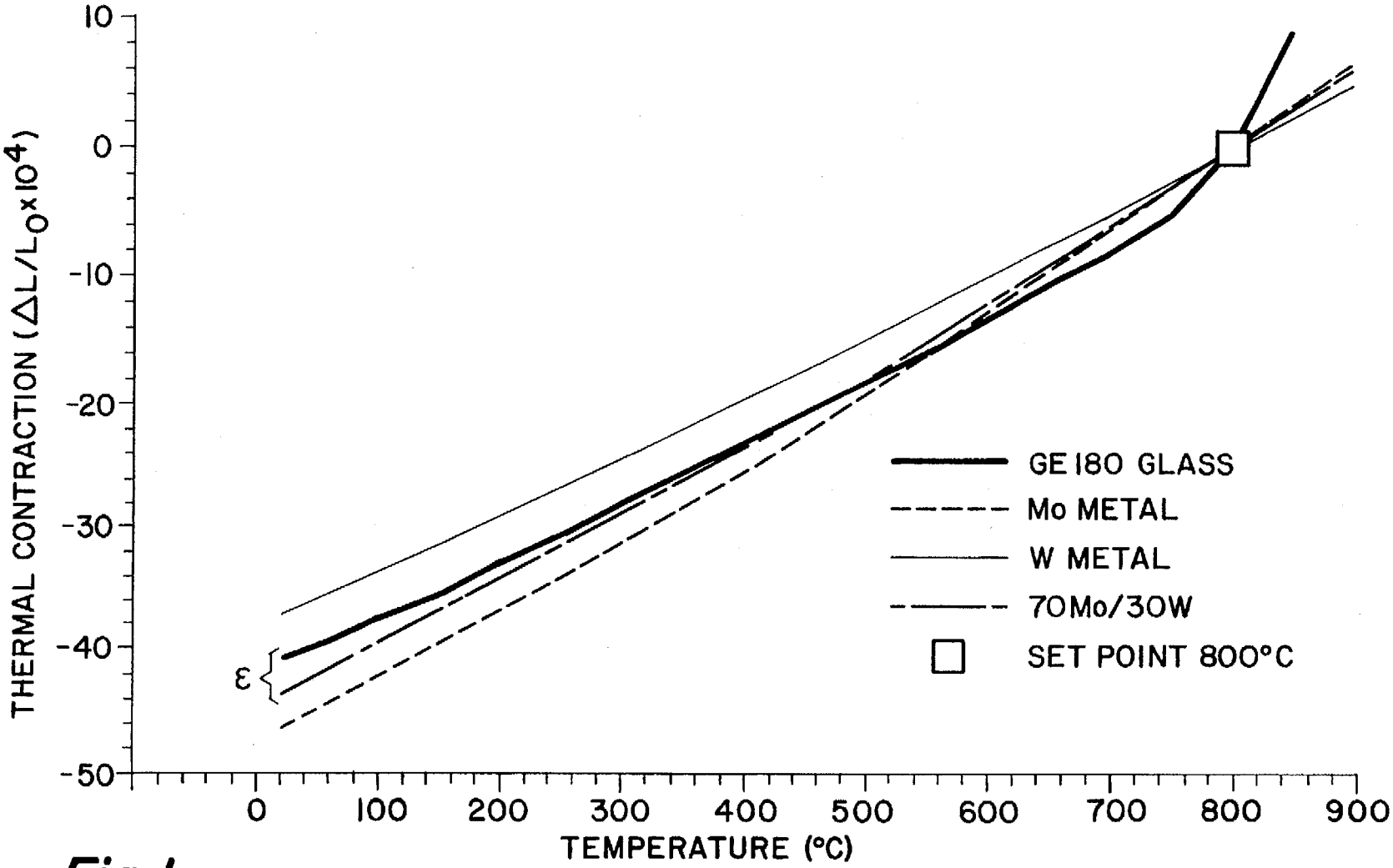
FIG. 1 is a graphical representation of the respective thermal contraction rates of tungsten, molybdenum, aluminosilicate glass and an approximation for an alloy of (70%) molybdenum and (30%) tungsten.

Reference will now be made in detail to the present preferred embodiment of the invention, an example of which is illustrated in the accompanied drawings. While the invention will be described in connection with the preferred embodiment, it will be understood that it is not intended to limit the invention to that embodiment but is intended to cover all alternatives, modifications and equivalents as may be included within the spirit and scope of the invention.

A primary difficulty in the preparation of electric lamps whether incandescent or discharge, is sealing the electrically conductive leads, connected to the electrodes or filaments, at their interface with the lamp envelope. Particularly, a strong and durable hermetic seal is often required.

Glass and quartz do not have a specified melting point at which they exist as both solid and liquid mass. Rather, they gradually soften into a plastic state and finally a liquid as temperatures increase. At temperatures above its softening point, the material can be formed or worked into intricate shapes. "Soft" glasses soften at temperatures of approximately 700 degrees centigrade while "hard" glasses soften at higher temperatures. Quartz has a softening point above 1600 degrees centigrade.

Three temperature ranges must be considered in design and manufacture of glass or quartz bulbs for lamps. First, at room temperature, the materials exist in the elastic range. In the elastic range, glass and quartz return to their original shape after bending just like any other elastic material. However, glass and quartz are brittle and built-in stresses and surface defects cause them to break easily in the elastic range. Second, as the material is heated, it passes through the annealing range, crossing through its strain point, transformation point and annealing point. In the annealing range the glass exhibits viscoelastic or time and history dependent properties. In a third range, the plastic range, glass and quartz flow easily and relieve any stresses that are present.

The ideal temperature for sealing or pressing glass is just above its softening point at the set point of the glass. At this temperature the glass or quartz is hot enough to avoid being torn by tooling, and cool enough to allow its flow to be controlled. Glass and quartz also adhere to other materials at their respective softening points. It is at this temperature that glass and quartz are traditionally formed into lamp envelopes and the point at which electrical leads are inserted through the envelopes and sealed. With quartz and hard glass, this is a high temperature.

One embodiment of the current invention concerns forming improved seals by reducing mis-match stresses at the interface of the electrical leads and the lamp envelope. The lead comprised of an alloy of molybdenum and tungsten will be effective in many types of lamps, including but not limited to high pressure sodium discharge lamps, halogen lamps and mercury lamps. It is particularly preferred to use a lead comprised of an alloy of molybdenum and tungsten in conjunction with aluminosilicate glasses.

With regard to lamps formed from aluminosilicate glass, most use a molybdenum wire inlead or some modification thereof. However, the differences in thermal expansion of the molybdenum wire and the envelope glass create a high level of residual stress at the glass/metal seal area. This stress can lead to cracking and failure or life reduction in the lamp. It has been determined that an inlead comprised of an alloy of molybdenum and tungsten has a thermal expansion/contraction more closely matched to that of the glass.

The reduction in stress components achieved by a (70%) molybdenum and (30%) tungsten inlead with a General Electric 180 aluminosilicate glass bulb has been determined to be between about 20 to 55%. Furthermore, these lamps prepared utilizing the inlead of the current invention have reduced cracking and failures by at least 50%.

FIG. 1 demonstrates the thermal contraction of General Electric's type 180 aluminosilicate glass as compared to the thermal contraction of molybdenum, tungsten and an approximation for a (70%) molybdenum/(30%) tungsten alloy. As can be seen from FIG. 1, the rate of thermal contraction (change in length over initial length at 800° C.) of molybdenum exceeds that of the glass while that of tungsten falls below that of the glass. In contrast, the contraction rate of the glass and that of the (70%) molybdenum/(30%) tungsten alloy are more equivalent. Accordingly, either metal used alone fails to approximate the rate of thermal contraction for the glass, whereas the molybdenum tungsten alloy provides a rate of thermal contraction approaching that of the glass and therefore reducing the expansion/contraction induced mis-match stress experienced during the forming, cooling and use of the lamp. By such combination of molybdenum and tungsten having the properties as shown in the graph of FIG. 1, the present invention has achieved results that would not have otherwise been expected and accordingly, provides a solution to a problem that has been persistent in the lamp arts for some time.

Figure 2:
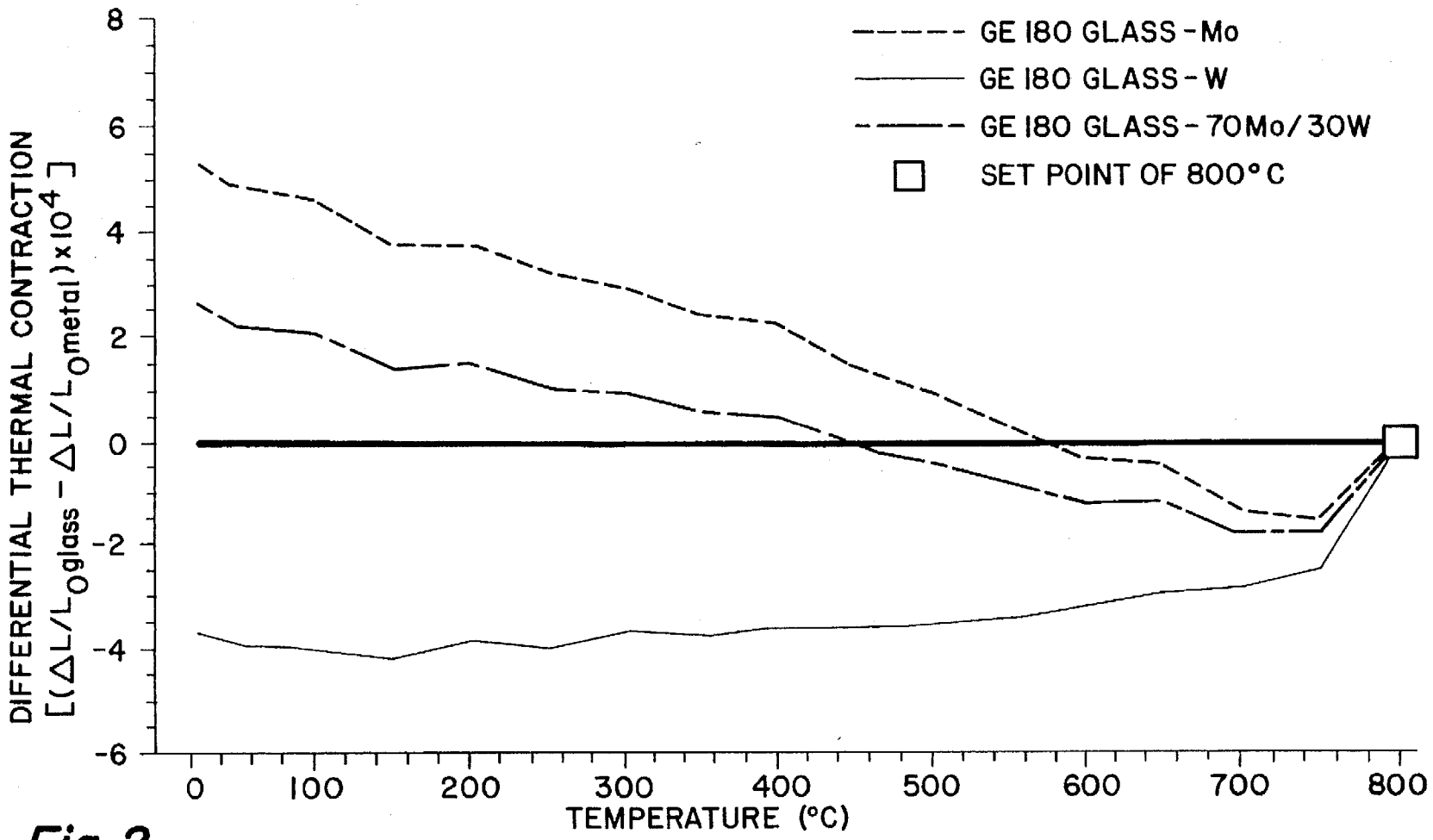
FIG. 2 is a graphical representation of the differential rates of thermal contraction between aluminosilicate glass and molybdenum metal, tungsten metal, and an approximation for an alloy of (70%) molybdenum and (30%) tungsten respectively.

FIG. 2 displays the differential thermal contraction (the change in length of the glass over its initial length at 800° C. minus the change in length of the metal over its initial length at 800° C.) of the molybdenum metal, tungsten metal and approximated (70%) molybdenum/(30%) tungsten alloy relative to General Electric 180 type aluminosilicate glasses. This graphical representation clearly demonstrates that the alloy of tungsten and molybdenum more closely matches the glass rate of contraction than does the molybdenum metal or tungsten metal currently used in the art.

Since each glass has an individual rate of thermal expansion/contraction and thermal history, the ratio of molybdenum and tungsten can be tailored to closely approximate the particular glass. For example, a higher percentage of tungsten will reduce the rate of thermal expansion of the alloy. Accordingly, General Electric's 180 type aluminosilicate glass annealed for a longer time at lower temperature than that the glass used FIGS. 1 and 2 will require an alloy of about (70%) tungsten and (30%) molybdenum. As a result of lamp forming processes, the important match in thermal expansion/contraction rates is between the elastic range and the approximate set point of the glass, and at operating temperatures.

Figure 3:
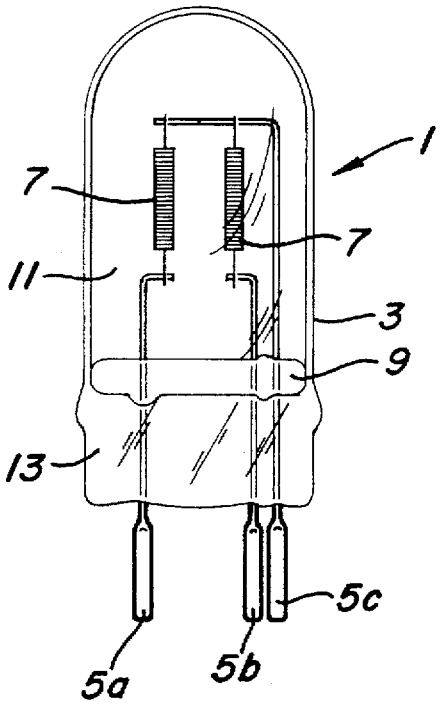
FIG. 3 is a schematic side view of a halogen incandescent lamp incorporating the molybdenum tungsten alloy leads in accord with the present invention.

FIG. 3 demonstrates a halogen lamp utilizing the leads of the current invention. Lamp 1 of FIG. 2 comprises an outer envelope 3 prepared from aluminosilicate glass. Three leads 5*a*, 5*b*, and 5*c* comprised of an alloy of molybdenum and tungsten conduct electricity to and from a pair of tungsten filaments 7. A glass bridge 9 lies inside the formed hollow envelope portion 11 and supports leads 5*a*, 5*b*, and 5*c*. The lamp is hermetically sealed at pinch seal 13. Not shown is a halogen fill.

According to the current invention, the contraction rate of leads 5*a*, 5*b*, and 5*c* at the interface with pinch seal 13 is more particularly matched than according to the prior art. Therefore, stress resulting from variations in the rates of thermal expansion/contraction between these materials are minimized and a longer lived lamp is produced.

With regard to quartz and hard glass halogen lamps, an additional advantage achieved by the current invention is a decrease in the degradation of the lead inside the lamp chamber by what is referred to as the "cold leg corrosion" mechanism.

In ordinary incandescent lamps, tungsten atoms evaporated off the filament condense as an opaque deposit on the inner lamp walls and reduce light output. In the operation of a halogen lamp, tungsten atoms evaporated off the filament chemically react with halogen species in the cooler parts of the lamp to form volatile, non-opaque tungsten-containing compounds. Upon encountering the hot filament, these volatile tungsten-containing compounds are chemically decomposed back to tungsten and halogen species and thus the wall cleaning cycle continues. In the cooler parts of the lamp, the halogen species are also able to chemically react with and corrode metals. Consequently, there is some degradation of the lead material. This is known as the "cold leg corrosion" mechanism. Generally, this degradation is controlled by using just enough halogen to prevent wall darkening, but yet avoiding the excess which would cause lead failure. Utilizing the current alloy of tungsten and molybdenum, the leads experience a lower rate of degradation than if pure molybdenum leads are used. While not wishing to be bound by theory, it is believed that the thermodynamic activity of the alloy is reduced by the proportion of added tungsten and consequently has a lower potential to corrode. Furthermore, as the molybdenum is corroded from the surface of the alloy lead, a surface of less reactive tungsten may remain which would inhibit further corrosion.

A further advantage of the alloy of molybdenum and tungsten used as an inlead in quartz and glass lamps its reduced tendency for oxidation. Also, tungsten oxide is more stable than molybdenum oxide. Adding tungsten to the molybdenum lead typically employed in the art elevates the oxidation resistance of the entire lead.

Accordingly, in aluminosilicate glass halogen lamps, the leads of the current invention are less effected by the "cold leg corrosion" mechanism than pure molybdenum, extending their life. Oxidation is also reduced and the thermal expansion is more closely matched to the glass envelope resulting in decreased mis-match strain and decreased cracking and/or fatigue of the lamp pinch seal. When the leads of the current invention are used with other glasses, for example, borosilicates, oxidation resistance and a more tailored thermal expansion match reducing stress are also achieved. Quartz lamps will also achieve increased oxidation resistance and, in the case of halogen lamps, molybdenum "cold leg corrosion" degradation will be reduced.

Thus, it is apparent that there has been provided, in accordance with the invention, a new and improved lamp lead that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

Having thus described the invention it is claimed:

1. An electric lamp comprising a sealed vitreous envelope defining a hollow portion and at least one electrode lead extending through said envelope into said hollow portion, said lead comprised of an alloy comprised of about 10 to 90 percent by weight tungsten and about 10 to 90 percent by weight molybdenum.

2. The lamp of claim 1 further comprising a pinch seal forming a hermetic seal between said lead and said envelope.

3. The lamp of claim 1 further comprising a shrink seal forming a hermetic seal between said lead and said envelope.

4. The lamp of claim 1 further comprising a fill gas in said hollow portion.

5. The lamp of claim 1 wherein said vitreous envelope is comprised of quartz.

6. The lamp of claim 1 wherein said vitreous envelope is comprised of borosilicate glass.

7. The lamp of claim 1 wherein said envelope is comprised of aluminosilicate glass.

8. The lamp of claim 4 further comprising a halogen fill gas in said hollow portion.

9. The lamp of claim 8 further comprising a tungsten filament electrically connected with said lead in said hollow portion.

10. The lamp of claim 7, wherein said alloy comprises between about 60 to 80 percent by weight molybdenum and about 20 to 40 percent by weight tungsten.

11. The lamp of claim 10, wherein said alloy comprises about 70 percent by weight molybdenum and about 30 percent by weight tungsten.

12. The lamp of claim 1 comprising an incandescent lamp.

13. The lamp of claim 1 comprising a discharge lamp.

* * * * *